US005585891A

United States Patent [19]

Altrieth et al.

[11] Patent Number: 5,585,891

[45] Date of Patent: Dec. 17, 1996

[54] SET-UP NAVIGATION SCHEME FOR PROGRAMMING REPRODUCTION APPARATUS

[75] Inventors: Frederick E. Altrieth, Scottsville; Yvonne K. Pensgen, Rochester, both of N.Y.

[73] Assignee: Eastman Kodak Company, Rochester, N.Y.

[21] Appl. No.: 412,427

[22] Filed: Mar. 29, 1995

[51] Int. Cl.[6] ..... G03G 21/00

[52] U.S. Cl. ..... 355/209; 355/202

[58] Field of Search ..... 355/202, 209; 345/48, 50–51, 118–121, 123–125, 173

[56] References Cited

U.S. PATENT DOCUMENTS

| | | | |
|---|---|---|---|
| 5,045,880 | 9/1991 | Evanitsky et al. | 355/200 |
| 5,049,931 | 9/1991 | Knodt | 355/209 |
| 5,105,220 | 4/1992 | Knodt et al. | 355/209 |
| 5,109,252 | 4/1992 | Schott | 355/202 |
| 5,113,222 | 5/1992 | Wilson et al. | 355/209 |
| 5,182,796 | 1/1993 | Shibayama et al. | 395/156 |
| 5,185,628 | 2/1993 | Wilson et al. | 355/209 |
| 5,200,778 | 4/1993 | Ito | 355/204 |
| 5,243,381 | 9/1993 | Hube | 355/204 |
| 5,463,448 | 10/1995 | Wilson et al. | 355/202 |
| 5,467,170 | 11/1995 | Wilson et al. | 355/209 |

*Primary Examiner*—Matthew S. Smith
*Attorney, Agent, or Firm*—Lawrence P. Kessler

[57] ABSTRACT

A reproduction apparatus for making copies of information, the reproduction apparatus having a plurality of operating features and accessories selectable to produce a copy job according to preselected operating feature and accessory selected parameters, and a device for programming the reproduction apparatus to accomplish a copy job according to the preselected operating parameters. The programming device comprises an operator control interface for displaying, one at a time, display screens from a plurality of display screens at a standard operating feature level, a job specific level, and a page specific level. The plurality of display screens respectively show selectable operating features and accessory setup parameters, and the particular operator selections from selectable operating features and accessory setup parameters to establish preselected operating parameters. Navigation between display screens, at a given program level, is accomplished directly without having to return to an alternate programming level. Signals are produced respectively representing such preselected operating parameters. A logic and control means generates and addresses the display for recording and storing the signals from the operator control interface, and controls the reproduction apparatus to produce a copy job in accordance with the signals.

6 Claims, 9 Drawing Sheets

SET-UP NAVIGATION SCHEME FOR PROGRAMMING REPRODUCTION APPARATUS

BACKGROUND OF THE INVENTION

The present invention relates in general to programing job set-up for reproduction apparatus, and more particularly to a set-up navigation scheme for simplifying the programing a reproduction apparatus.

Reproduction apparatus available today, such as copier/duplicators or printers and the like, have become more complex and versatile in operation. They are extremely sophisticated and can accomplish a wide range of reproduction routines. That is, such reproduction apparatus include many automatic accessories and function in many different operational modes. Some examples of automatic accessories include document handlers, sorters, staplers, and other various finishing devices. With a combination of accessories, the reproduction apparatus is capable of operating in a variety of modes with various setup parameters such as copy mode, receiver supply, stapler or other finishing operation, copy output, contrast, density, reduction or magnification, and image shift. Further, the operator can choose between simplex-to-simplex, simplex-to-duplex, duplex-to-simplex, or duplex-to-duplex reproduction modes of operation.

Due to the complexity of such reproduction apparatus, it is difficult for the casual operator to set up the operating parameters for all but the most basic reproduction jobs. To somewhat simplify the setup procedure, the available accessory options and the various modes of operation for the reproduction apparatus are displayed for the operator on a series of information display screens of an operator control interface panel. Functions for operational parameter setup of the reproduction apparatus, inputted by the operator via the display screens, may include job level features, page level features, and/or area level features.

For the functions for operational parameter setup of the reproduction apparatus, job level features may include the number of copy sets requested, color, exposure, magnification, receiver supply, simplex or duplex original documents or copies, collation, finishing, covers, zoom, or transparency interleaving. Page level features may include contrast, brightness, screening for reducing a continuous tone original document into dots for reproduction as a half-tone image, positive-to-negative image reversal, auto-magnification, x- and y- scaling, stacking, pamphlet, book copy, edge erase, image combine, separators, and image shifting. Area level features include selected area erase, contrast, brightness, image shift, magnification, image reversal, accent color, screening, highlighting, and color substitution. Of course, many of the features for one level may be utilized at a different level.

Moreover, such reproduction apparatus can provide detailed self-diagnostics in order to indicate when supplies have to be replenished or when operating functions significantly deviate from the acceptable range. Of course, the ultimate utility of the reproduction apparatus depends substantially upon the success which an operator has in using the reproduction apparatus. The operator's success is directly related to the ease of use of the reproduction apparatus, and the ease of learning about the use of the reproduction apparatus. Accordingly, the interface between the reproduction apparatus and the operator must be uncomplicated and, to as great an extent as possible, understandable to use in order to provide full and efficient utilization of the apparatus.

To operate such reproduction apparatus to perform a reproduction routine for a copying job, the operator may have to make a large number of decisions about how the operating features of the reproduction apparatus will be set to perform a particular reproduction routine, or default to nominal settings. Moreover, certain operating features of the apparatus can be used selectively on all or only certain ones of the pages of a job, e.g., to provide color on only certain pages, but margin erase on all pages. It can be appreciated that reproduction routine setup for high speed reproduction apparatus can be of such complexity that even skilled operators find it time consuming and challenging.

Since copy jobs often involve the production of many copy sets, errors in reproduction routine set-up can be costly. In order to facilitate reproduction routine set-up, various touch-selection screen display devices have been developed to show apparatus mode and operating feature selection options in sequential screen displays, along with prompting instructions. As a further improvement for facilitating operator setup, the operator communication/control interface, such as described in U.S. Pat. No. 5,113,222 (issued May 12, 1992, in the names of Wilson et al) separates the operator selection process, presented on the display screens of a reproduction apparatus operator control interface, into three selection levels, a standard feature level, a special features-job level and a special features-page level. Within each selection level a series of screens can be sequentially addressed onto the display device to assist the operator in selections of operating features available at that level. Indicia (e.g., a solid box) can be provided next to a selection(s) on the different level options screens to indicate an operating feature has been selected at that level. However, it is still quite a burdensome task for the operator to setup feature selections at various stages of the selection procedure.

SUMMARY OF THE INVENTION

In view of the foregoing discussion, this invention is directed to a reproduction apparatus for making copies of information, the reproduction apparatus having a plurality of operating features and accessories selectable to produce a copy job according to preselected operating feature and accessory selected parameters, and a device for programming the reproduction apparatus to accomplish a copy job according to the preselected operating parameters. The programming device comprises an operator control interface for displaying, one at a time, display screens from a plurality of display screens at a standard operating feature level, a job specific level, and a page specific level. The plurality of display screens respectively show selectable operating features and accessory setup parameters, and the particular operator selections from selectable operating features and accessory setup parameters to establish preselected operating parameters. Navigation between display screens, at a given program level, is accomplished directly without having to return to an alternate programming level. Signals are produced respectively representing such preselected operating parameters. A logic and control means generates and addresses the display for recording and storing the signals from the operator control interface, and controls the reproduction apparatus to produce a copy job in accordance with the signals.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
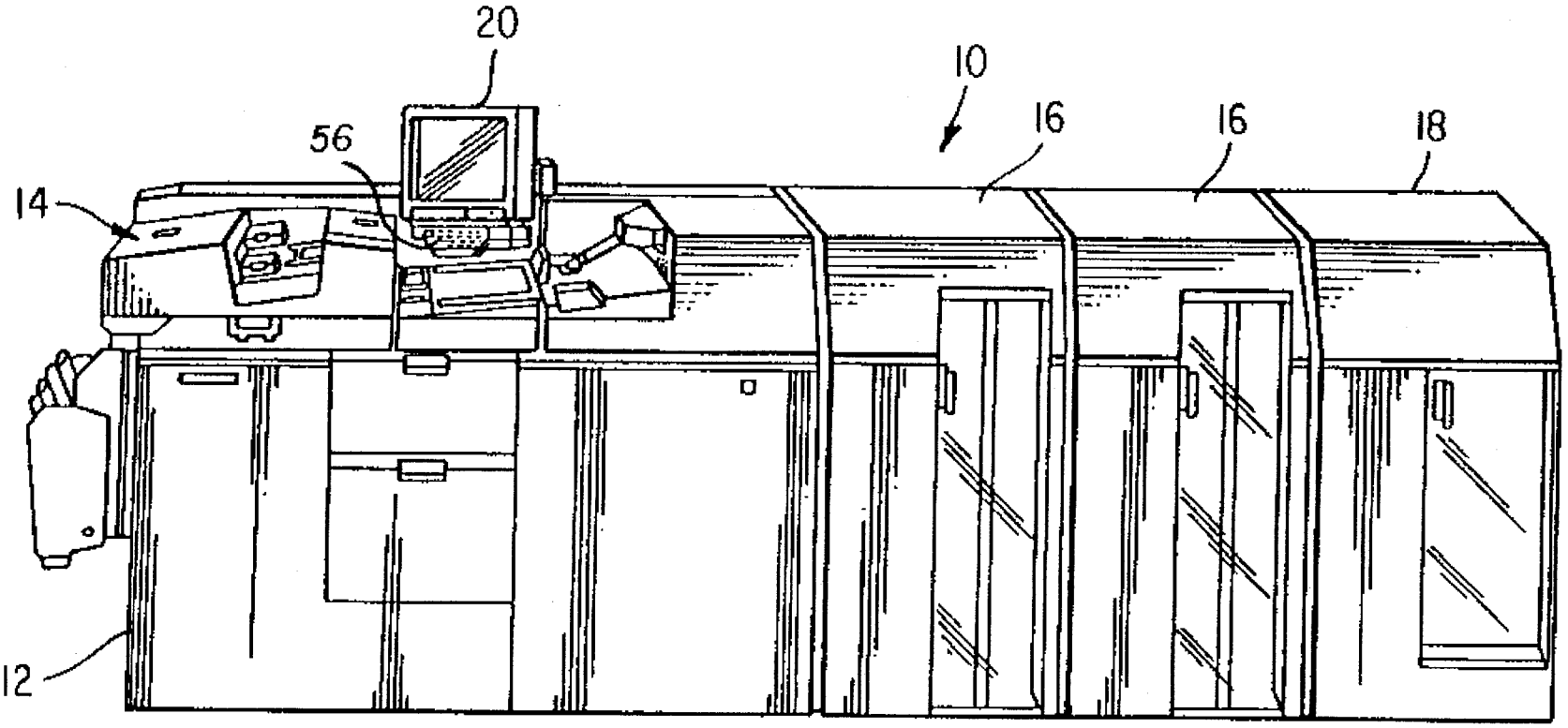
FIG. 1 is a front elevational view of a typical, well known, reproduction apparatus, including an operator control interface and various operating accessories for such reproduction apparatus.

Referring now to the accompanying drawings, FIG. 1 shows a typical reproduction apparatus, designated generally by the numeral 10. The reproduction apparatus 10 has an operator control interface 20, and a marking engine 12 for producing copies of original information, such as original documents circulated by a document feeder 14. Several well known finishing accessories, such as sorters 16 and stacker/stapler 18, are associated with marking engine 12. Of course, other well known marking engines and associated accessories, serving in various configurations as copiers or printers, are suitable for use with this invention.

Figure 2:
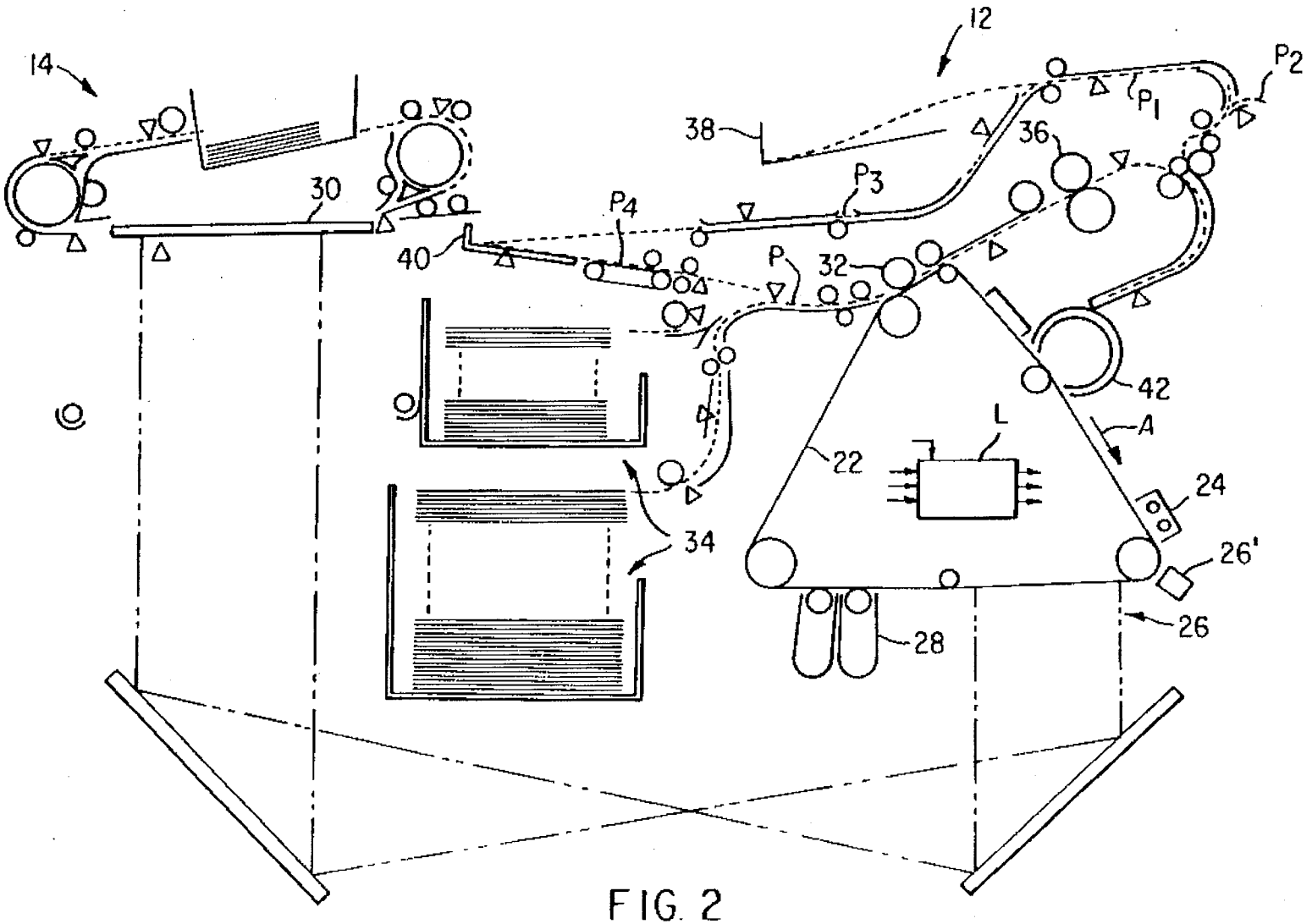
FIG. 2 is schematic front elevational view of a portion of a portion of the typical reproduction apparatus of FIG. 1, with portions removed to facilitate viewing.

The basic arrangement and operation of the exemplary marking engine 12 (and associated accessories) for the reproduction apparatus 10 is described with particular reference to FIG. 2 in sufficient detail for a complete understanding of this invention. The marking engine 12 has a dielectric support 22, in the form of an endless web mounted, for example, on tracking rollers for movement about an endless path in the direction indicated by the arrow A. In the reproduction cycle, the moving dielectric support 22 is uniformly charged as it moves past a primary charging station 24. Thereafter, the uniformly charged dielectric support passes through an exposure station 26 where the uniform charge is altered to form a latent image charge pattern corresponding to information desired to be reproduced. Depending upon the characteristics of the dielectric support and the overall reproduction system, formation of the latent image charge pattern may be accomplished by exposing the dielectric support 22 to a reflected light image of an original document to be reproduced. For example, the original document may be delivered to a transparent platen 30 by the document feeder 14. Alternatively, formation of the latent image charge pattern may be accomplished by "writing" directly on the dielectric support with a series of lamps 26' (e.g., LED's or lasers) or point electrodes activated by electronically generated signals based on the desired information to be reproduced.

The latent image charge pattern, as formed on the dielectric support 22, is the brought into association with a development station 28 which applies pigmented marking particles to adhere to the dielectric support to develop the latent image. The portion of the dielectric support 22 carrying the developed image then passes through a transfer station 32 in register with a receiver member, fed in proper timed relation from a supply hopper 34, along the path P. An electric field produced in the transfer station 32 attracts the marking particles of the developed image from the dielectric support to the receiver member.

The electric transfer field may also cause the receiver member to adhere to the dielectric support 22. Accordingly, a detack mechanism (not shown), immediately downstream in the direction of travel of the dielectric support, is provided to facilitate removal of the receiver member from the dielectric support. The detack mechanism may be, for example, an AC corona charger for neutralizing the attractive field holding the receiver member to the dielectric support. After the developed image is transferred to the receiver member and the receiver member is separated from the dielectric support, the receiver member is transported through a fusing device 36 where the image is fixed to the receiver member by heat and/or pressure, for example.

The receiver member bearing the fixed image is then selectively delivered to an appropriate desired output. The receiver member may be directed along path $P_1$ to a top exit hopper 38 for direct operator retrieval, or along path $P_2$ through a side exit for delivery to one of the output accessories (elements 16, 18 shown in FIG. 1). Alternatively, the output may be directed from path $P_1$ along the path $P_3$ to an intermediate hopper 40. In the path $P_3$, the receiver member is effectively turned over, and thereafter delivered along the path $P_4$ to return to the path P and the transfer station 32 to enable a duplex reproduction to be formed on such receiver member. Simultaneously, with delivery of the receiver member to the desired output, the dielectric support 22 is cleaned of any residual marking particles at cleaning station 42 and returned to the primary charging station 24 for reuse.

In the arrangement as shown for the typical reproduction apparatus 10 (or any other suitable arrangement), it is apparent that many different modes of operator selectable operations or functions are possible. For example, duplex document booklets may be formed from simplex or duplex original information, or information to be copied may be edited to change its size, content, or orientation. Further, the typical reproduction apparatus 10 has the ability to communicate to the operator its status with regard to operating conditions or supply status, for example. As will be appreciated, with such communication required between the operator and the apparatus or the apparatus and the operator, a highly sophisticated communication interface is required.

Figure 3:
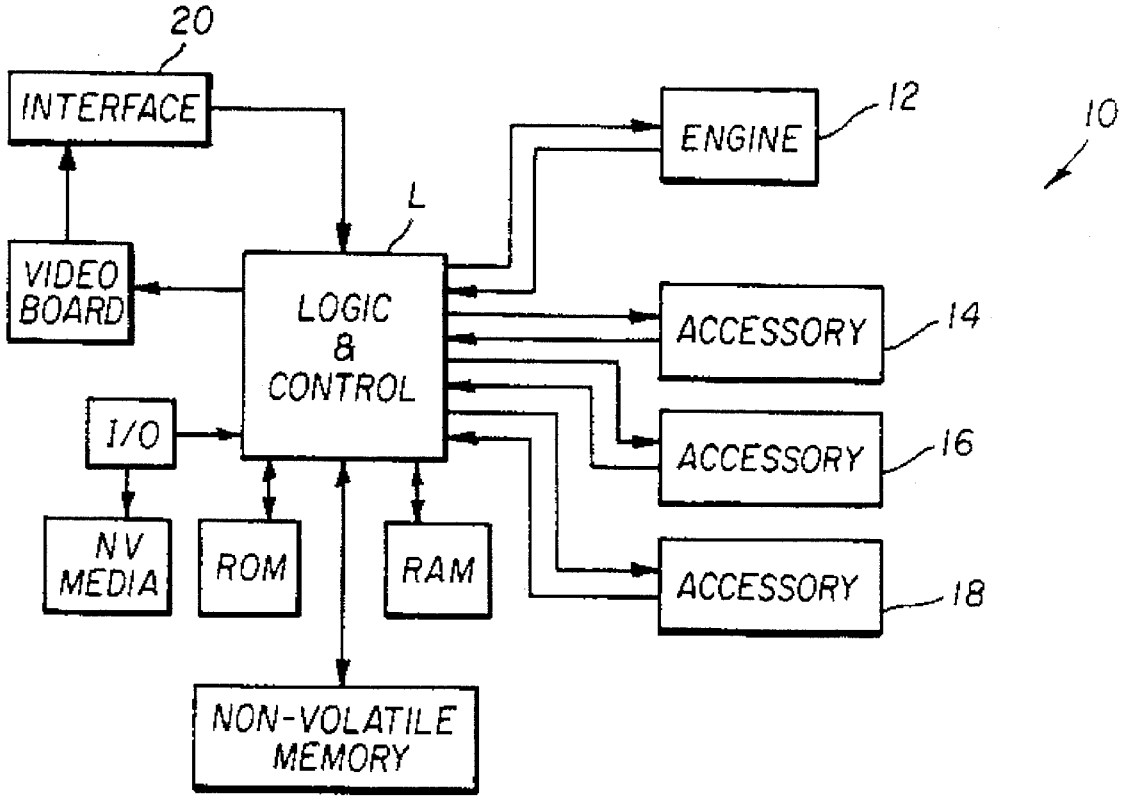
FIG. 3 is block diagram of the control for the typical reproduction apparatus of FIG. 1.

The operator control interface 20 includes, for example, a CRT having a touch activated screen with or without manually activated keys (of course, other operator control interfaces such as those of the type having only a plurality of sets of manually activated keys are suitable for use with this invention). The operator control interface 20 is electrically coupled in any well known manner to a logic and control unit L located, for example, within the housing of the reproduction apparatus 10. The logic and control unit L, as best shown in FIG. 3, includes a microprocessor based controller electrically coupled to the marking engine and accessories of the reproduction apparatus 10. The controller includes random access memory (RAM), read only memory (ROM), and non-volatile memory. The controller may also include a reader/writer to non-volatile media, such as a disk. Of course, the operator control interface 20 may alternatively include a stand-alone logic and control unit which would then, in turn, be electrically coupled to the logic and control unit L of the reproduction apparatus 10.

In order to control the operation of the reproduction apparatus 10, the controller of the logic and control unit L receives input signals from the operator control interface 20 and a plurality of sensors associated in any well known manner with the reproduction apparatus marking engine 12 and accessories 14, 16, and 18. Based on such signals and a program for the microprocessor, the logic and control unit produces appropriate signals to control the various operating devices within the reproduction apparatus. The production of a program for a number of commercially available microprocessors is a conventional skill well understood in the art and does not form a part of this invention. The particular details of any such program would, of course, depend upon the architecture of the designated microprocessor.

Figure 4:
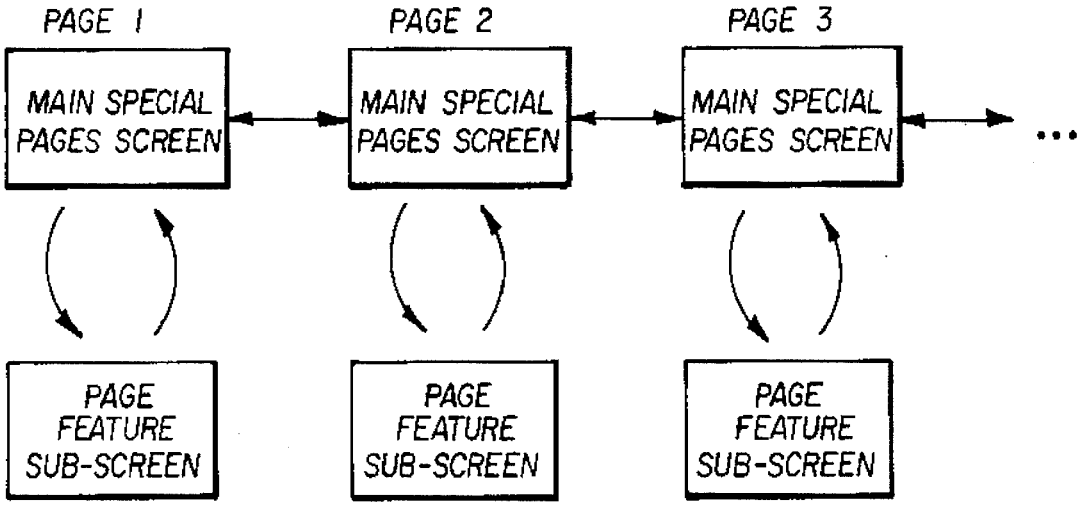
FIG. 4 (prior art)
FIG. 4 is flow chart of a typical prior art navigation scheme for operating parameter setup for the typical reproduction apparatus of FIG. 1.

As noted with regard to the aforementioned U.S. Pat. No. 5,113,222, in order to facilitate copy job setup (i.e., make it more readily user-friendly for the operator), information relative to copy job parameter setup, presented on the display screen of the operator control interface, is separated into three basic selection levels: a standard operating feature level, a job specific level, and a page specific level. FIG. 4 shows a flow chart depicting the prior known scheme for navigating through reproduction apparatus copy job setup procedures at the special feature-page level. Specifically, the operator must access a main menu special feature screen which displays the available page level special feature options. The operator then sequentially sets up all of the desired selected page level special feature options for a particular page. Thereafter, the operator must again return to the main menu special feature screen, go to the next page, and repeat the process for the next page, and so forth until all of the selected page level special feature options, for each page of the copy job, are set up.

Figure 5:
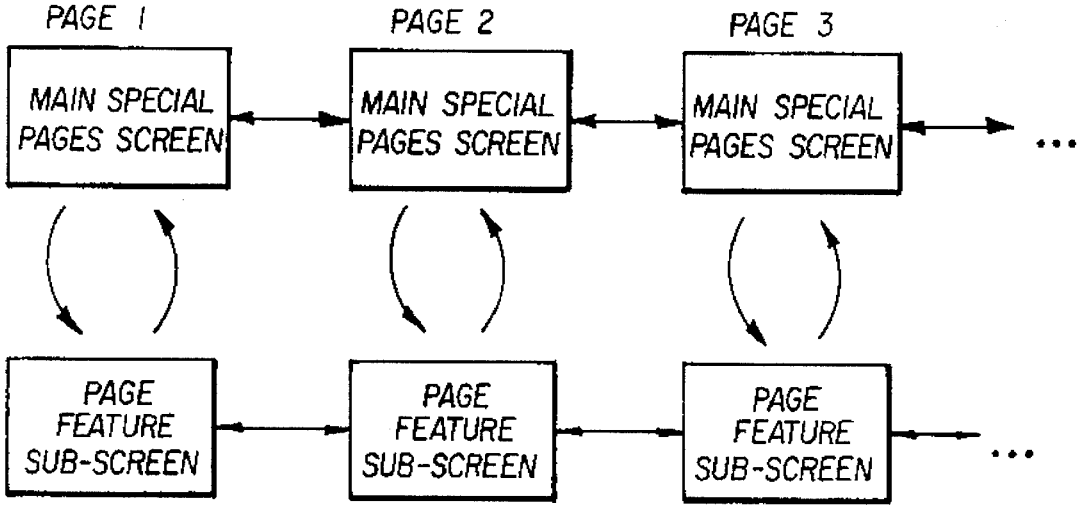
FIG. 5 is flow charts of a simplified navigation scheme, according to this invention, for operating parameter setup for the typical reproduction apparatus of FIG. 1.

Often times however, a specific selected page level special feature option, and its particular setup parameters, is duplicated for subsequent pages in the same copy job. Therefore, in order to simplify the special feature option parameter setup navigation scheme, according to this invention, the logic and control unit L enables the operator to set up a specific page level special feature option for all appropriate pages in the copy job without the necessity of returning to the main menu special feature screen display after setup for each page. The navigation scheme according to this invention is shown in the flow chart of FIG. 5.

FIGS. 6–10 inclusive show respective display screens for the operator control interface 20 of the reproduction apparatus 10, particularly those screens utilized in set up of page level special features according to the navigation' scheme of this invention. While the example shown in the Figures relates to the page level "sub-set staple" special feature option parameter setup, it is of course understood that this navigation scheme is also appropriate for the set up of parameters for other special feature options available for copy job production by the reproduction apparatus 10, at the page level, or various other program levels. In general, the display screen in each of the FIGS. 6–10 includes a top banner section 60, a message section 70, a lower banner section 80, and a main display field 90. The top banner section 60 is used in displaying information relative to the general status of the reproduction apparatus 10, while the lower banner section 80 is used in displaying the generic name for the level of the information of the main display field 90 (as well as the time and date). The message section 70 provides an area where appropriate information or directions to the operator can be readily displayed.

Figure 6:
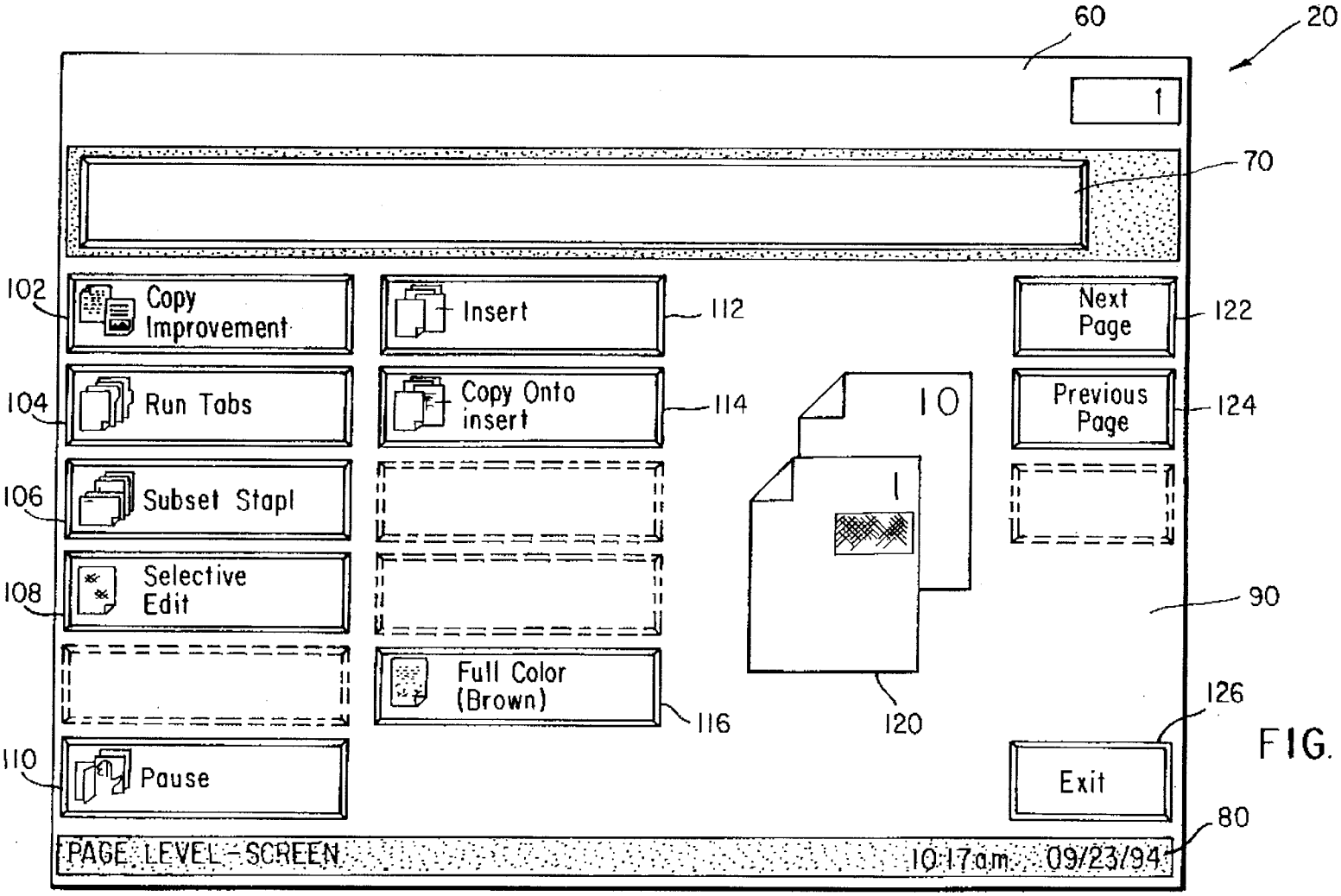
FIG. 6 is a view of the display screen of the operator control interface for the typical reproduction apparatus of FIG. 1, depicting a menu of available feature options for setting up parameters for such reproduction apparatus, at a page level of programming.

When it is desired to set up the parameters for page level special feature options, the operator selects a key (not shown) on the operator control interface 20 designating the "page level special features". At such time, the screen display shown in FIG. 6 will appear. In FIG. 6, the display screen of the operator control interface 20 is shown as depicting the main menu for available page level special feature options for the reproduction apparatus 10. The lower banner 80 indicates that the information contained in the main display field 90 of the display screen is directed to the "page level" options of the reproduction apparatus. Substantially well known page level special feature options, displayed as representations of keys, include the "copy improvement" key 102, the "run tabs" key 104, the "subset staple" key 106, the "selective edit" key 108, the "pause" key 110, the "insert" key 112, the "copy onto insert" key 114, and the "full color" key 116. Also represented in the main display field 90 is a schematic illustration 120 of the copy job, particularly indicating the number of pages in the copy job, and navigation keys 122, 124, 126. The navigation keys 122 and 124 enable the operator to move from page to page (either in ascending page order or descending page order), and the navigation key 126 enables the operator to move out of the page level special feature option selection screen.

Figure 7:
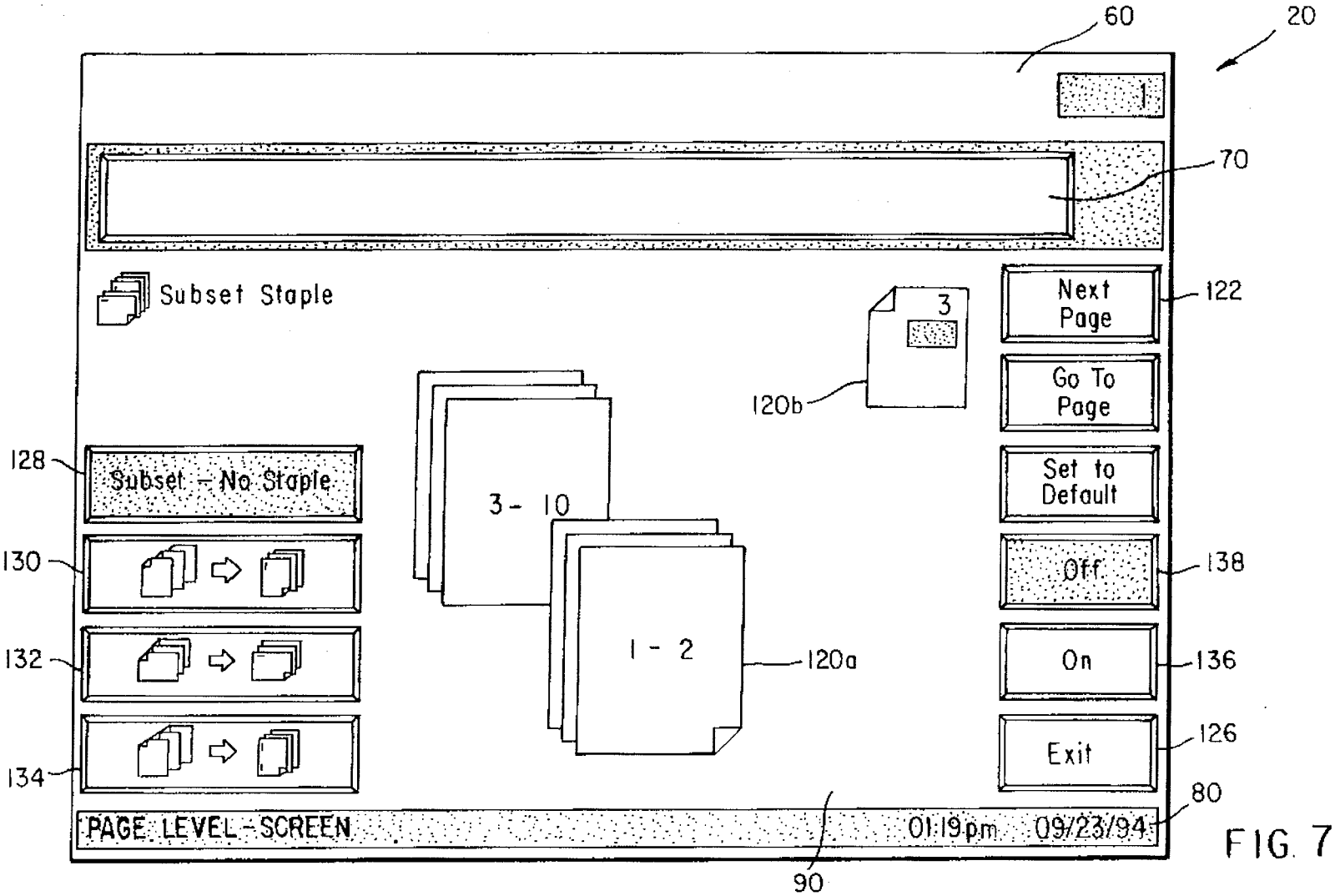
FIG. 7 is a view of the display screen of the operator control interface depicting successful selection of a particular option from the menu of available feature options shown in FIG. 6.

When the key operator selects, for example, the "subset staple" special feature option from the display screen shown in FIG. 6 by touching the key 106, the display screen shown in FIG. 7 appears. In this display screen, the lower banner 80 indicates that the apparatus is in the routine where the operator can selectively determine the page level special feature options for accomplishing subset stapling; i.e., dividing the pages of a copy job into groups, such as by stapling particular pages together. The main field 90 of the display screen shows various keys for the associated subset staple special feature option setup parameters. Specifically, key 128 represents "subset—no staple", key 130 represents "single staple—portrait", key 132 represents "single staple—landscape", and key 134 represents "double staple—portrait". Additionally, the main field shows a schematic illustration **120*a* of the copy job with subset stapling, a schematic illustration 120*b* of the a particular numbered page, navigation keys 122 and 126, and selected feature activating key 136 (on) and selected feature deactivating key 138** (off).

Figure 8:
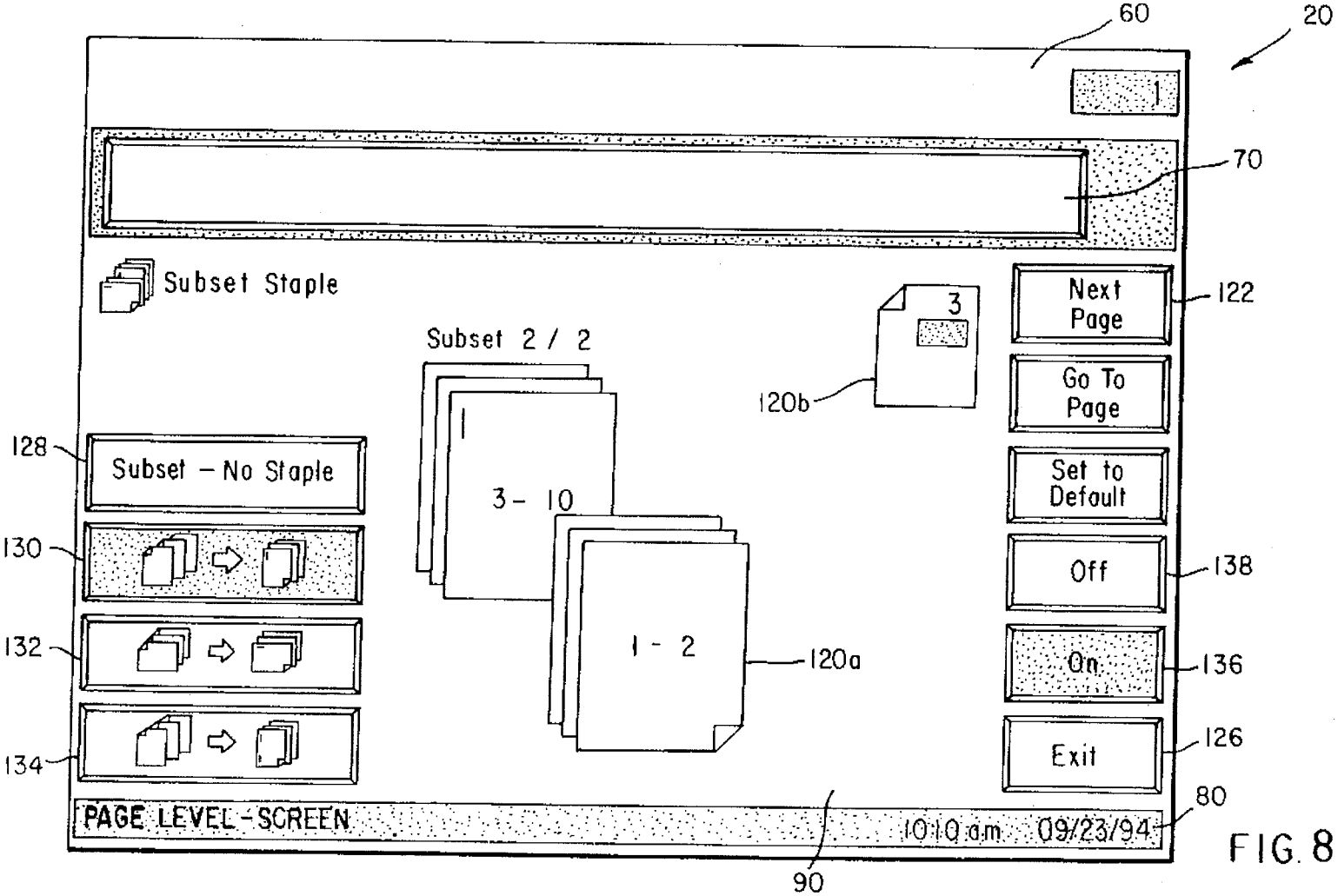
FIG. 8 is a view of the display screen of the operator control interface depicting a parameter setup for the selected particular feature option, as applied to an appropriate page of a copy job.

At this point, the operator may proceed to set up the various parameter aspects of the subset staple special feature option. The display screen shown in FIG. 8 shows an example of a particular set up effected by the operator.

Specifically, the "one staple—portrait" mode has been selected to start on "page number 3", and such feature has been turned "on". Such selections are shown as being highlighted (for example, white lettering on a contrasting background). The operator can then scroll directly to the next numbered page at which a subset is to begin by touching the navigation key 122. By this navigation scheme, according to this invention, it is not necessary to return a higher level programming screen, such as the main menu screen shown in FIG. 6.

Figure 9:
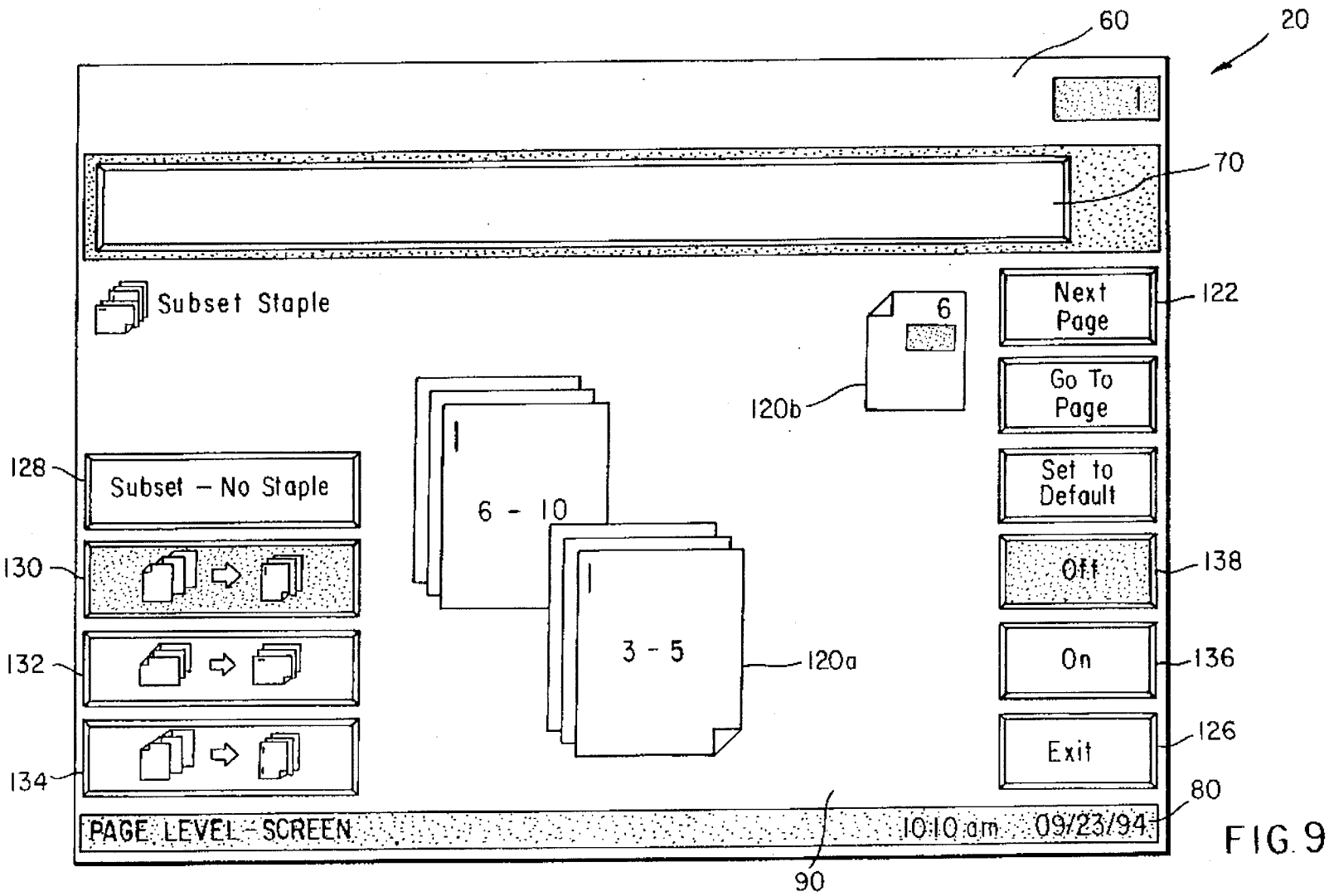
FIG. 9 is a view of the display screen of the operator control interface depicting a parameter setup for the selected particular feature option, as applied to a subsequent appropriate page of the copy job.

When the next particular page at which a subset is to begin has been reached, the display screen for the operator control interface 20 will appear as shown in FIG. 9. Here it can be seen that the previously selected option (i.e., the "one staple—portrait" mode) has been set by the logic and control unit L to become the new default parameter setup selection, and is appropriately highlighted. This default reset to the previously selected parameter setup, by the logic and control unit, is automatically provided since it is common practice for parameter setups to be the same for the same special feature option on different pages in a particular copy job. However, the new default parameter setup selection is indicated as being set to "off", and must be proactively turned "on" by touching key 136. If the key 136 is not touched to turn "on" the new default parameter setup selection (i.e., the new default parameter selection is not activated), the parameter setup will revert back to the default parameter setup that existed before the default was reset to the new default parameter setup defined by the most recently selected parameter setup. Therefore, according to this invention, the operator is given the choice of selecting, as desired, the default parameter setup option or another option with a minimum of key strokes.

Figure 10:
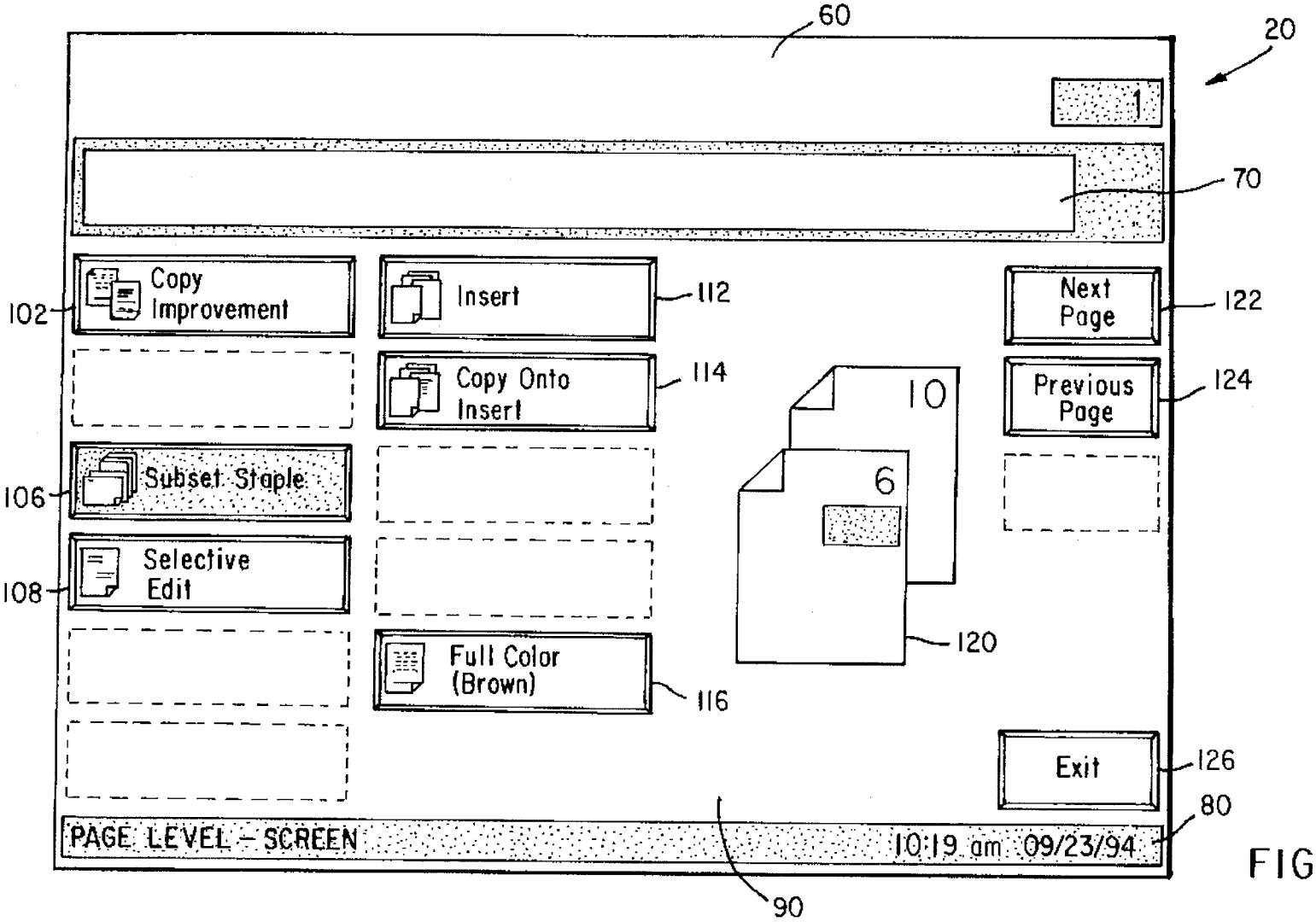
FIG. 10 is a view of the display screen of the operator control interface, similar to FIG. 6, depicting, on the menu of available feature options, successful setup of the selected particular feature option.

After the process has been repeated for all of the desired subsets in the copy job, the operator touches the navigation key 126 (exit), and is returned to the screen shown in FIG. 10. As will be appreciated, FIG. 10 depicts the main menu display screen (substantially as shown in FIG. 6), but with the particular selected setup parameters being shown as highlighted. The operator can thus readily assess whether the preselected parameters for the copy job have been fully and correctly set up. Thereafter, the operator may then proceed to select any of the other special feature options or may return to the main display screen (not shown) and actuate running of the set up copy job according to the preselected operating parameters.

The invention has been described in detail with particular reference to preferred embodiment thereof, but it will be understood that variations and modifications can be effected within the spirit and scope of the invention as set forth in the claims.

What is claimed is:

1. A reproduction apparatus for making copies of information, said reproduction apparatus having a plurality of operating features and accessories selectable to produce a copy job according to preselected operating feature and accessory selected parameters, and means for programming said reproduction apparatus to accomplish a copy job according to said preselected parameters, said programming means comprising:

an operator control interface including means for displaying, one at a time, display screens from a plurality of display screens at a standard operating feature level, a job specific level, and a page specific level, said plurality of display screens respectively showing selectable operating features and accessory setup parameters, and the particular operator selections from selectable operating features and accessory setup parameters to establish preselected operating parameters, means for navigating between display screens, at a given program level, directly without having to return to an alternate programming level, and means for producing signals respectively representing such preselected operating parameters; and logic and control means for generating and addressing said display means for recording and storing said signals from said operator control interface signal producing means, and for controlling said reproduction apparatus to produce a copy job in accordance with said signals.

2. The reproduction apparatus programming means of claim 1 wherein said display screens scroll from one page to another for a given operating feature or accessory parameter setup, so that such operating feature or accessory parameter setup may be set up respectively for each page.

3. The reproduction apparatus programming means of claim 2 wherein said display screens scroll from one page to another at a page specific level.

4. A reproduction apparatus for making copies of information, said reproduction apparatus having a plurality of operating features and accessories selectable to produce a copy job according to preselected operating feature and accessory selected parameters, and means for programming said reproduction apparatus to accomplish a copy job according to said preselected parameters, said programming means comprising:

an operator control interface including means for displaying, one at a time, display screens from a plurality of display screens at a standard operating feature level, a job specific level, and a page specific level, said plurality of display screens respectively showing selectable operating features and accessory setup parameters, and the particular operator selections from selectable operating features and accessory setup parameters to establish preselected operating parameters, means for navigating between display screens, at a given program level, directly without having to return to an alternate programming level, and means for producing signals respectively representing such preselected operating parameters; and logic and control means for generating and addressing said display means for recording and storing said signals from said operator control interface signal producing means, and for controlling said reproduction apparatus to produce a copy job in accordance with said signals, said logic and control means including means for indicating on a display screen, as new default parameters, operator selections from a preceding screen at the same programming level, and means for causing said new default parameters to reset to previous default parameters unless said new default parameters are pro-actively selected.

5. In a reproduction apparatus for making copies of information, said reproduction apparatus having a plurality of operating features and accessories selectable to produce a copy job according to preselected operating feature and accessory selected parameters, a method for programming said reproduction apparatus to accomplish a copy job according to said preselected operating parameters, said method comprising the steps of:

displaying, one at a time, display screens from a plurality of display screens at a standard operating feature level, a job specific level, and a page specific level, said plurality of display screens respectively showing selectable operating features and accessory setup parameters;

selecting, from the display on respective display screens, particular selections from selectable operating features and accessory setup parameters to establish preselected operating parameters;

navigating between display screens, at a given program level, directly without having to return to an alternate programming level;

producing signals respectively representing such preselected operating parameters;

generating and addressing respective display screens for recording and storing said produced signals representing such preselected operating parameters; and controlling said reproduction apparatus to produce a copy job in accordance with said produced signals representing such preselected operating parameters.

6. The method for programming said reproduction apparatus to accomplish a copy job according to said preselected operating parameters of claim 5 wherein said navigation step is accomplished by scrolling from one page to another at a page specific level.

* * * * *